United States Patent [19]

Ayyoubi et al.

[11] Patent Number: 4,892,499

[45] Date of Patent: Jan. 9, 1990

[54] NOVELTY GRINDER

[76] Inventors: Luay Ayyoubi, P.O. Box 8636, The Woodlands, Tex. 77387-8636; Theresa R. Beck, 27220 Blueberry Hill Dr., Conroe, Tex. 77385

[21] Appl. No.: 267,227

[22] Filed: Nov. 4, 1988

[51] Int. Cl.[4] ..... A63H 5/00

[52] U.S. Cl. ..... 446/81; 446/265; 446/489; 446/418; 215/228

[58] Field of Search ..... 446/489, 81, 405, 397, 446/418, 420, 408, 404, 246, 265, 266, 71, 77; 206/216; 215/228, 220

[56] References Cited

U.S. PATENT DOCUMENTS

| | | | |
|---|---|---|---|
| 3,085,709 | 4/1963 | Klein | 215/228 X |
| 3,214,862 | 11/1965 | Price | 446/489 X |
| 3,478,932 | 11/1969 | Phillips | 446/418 X |
| 3,665,639 | 5/1972 | Knox | 446/489 |
| 4,003,159 | 1/1977 | Piper | 446/397 |

*Primary Examiner*—Mickey Yu
*Attorney, Agent, or Firm*—William E. Shull

[57] ABSTRACT

A novelty grinder includes a grinder base with a pair of guide channels extending across its upper surface and intersecting near its center. The guide channels are preferably perpendicular to one another, and dovetailed in transverse cross-section. A pair of shuttle members or shoes is slidably disposed in the guide channels, each shoe being adapted for reciprocating translational movement in one of the channels. The shoes are preferably trapezoidal in transverse cross-section, and wider at their widest points than the widths of the channels at their upper edges. Alternatively, the channels may be straight-sided and provided with axially extending grooves for receiving pins disposed on the shoes for retaining the shoes in the grooves and preventing their removal in a direction transverse to the direction of their reciprocating movement. Such grooves may have a T-slot configuration for receiving a T-pin on the shoes. The T-slot may be on a side, or on the bottom, of a channel. A crank is pivotally connected to each shoe for causing the shoes to reciprocate when the crank is rotated about the grinder base. Serrations in the channels are engaged by ribs on the shoes to create a washboard sound effect when the shoes reciprocate. The grinder base may be mounted on a jar or other container.

4 Claims, 2 Drawing Sheets

NOVELTY GRINDER

BACKGROUND OF THE INVENTION

The present invention relates generally to novelty items or amusement devices, and more particularly to a novelty grinder which may be used, for example, as a humorous conversationstarter or display item, a noisemaker or rally-rouser at political conventions, parties, sporting events, or the like, or a mechanical curiosity item displaying elemental principles of combined rotary and reciprocating translational motion of its parts.

For many people, a sure way to provoke in them a chuckle or a grin, to pique their curiosity or tickle their funny bones, to amuse or entertain them, or possibly even to educate them in some way, is to show or give them a novelty or gag item. Noteworthy examples include the Rubik's Cube, the Pet Rock, and the Chinese Ring Puzzle. Some of these novelty or gag items are intended (1) to publicize or promote one's attitudes or beliefs, for example, his or her political, moral, or economic values or philosophies, and/or (2) to poke fun at or criticize, in a lighthearted way, the attitudes or beliefs of others. Examples of such items include motor vehicle bumper stickers, decorated T-shirts, and lapel buttons or pins.

A particularly simple and effective way to promote the attitudes or beliefs of an individual, or to indicate disapproval of another's, is to focus on the groups, institutions, or organizations of which those persons are members or with which they are affiliated in some way, or the causes which they support or with which they are otherwise associated. If, for example, a person is generally opposed to environmental causes, he or she might display an automobile bumper sticker which sets forth that opposition succinctly and in no uncertain, but quite often darkly comical, terms. Witness, for example, the "Nuke the Whales" sticker, which resorts to humorous hyperbole in the course of both advocating use of nuclear energy or demonstrating a hawkish political stance, and denigrating the well-known "save the whales" environmental movement. Another example is the "Ollie North for President" lapel pin which, in view of the events surrounding the United States government's notorious Iran-Contra investigation of late, quickly identifies the wearer, with tongue firmly in cheek, as sympathetic to Mr. North's political philosophies.

One of the objects of the present invention is to provide a unique, simple yet effective, humorous means for accomplishing the second of the two purposes referred to above, that is, subjecting the attitudes or beliefs of others to some lighthearted jibing. The present invention accomplishes this objective in part through the operator's first identifying or referring to such attitudes or beliefs as "baloney," "hogwash," or the like, and then symbolically "grinding it up" with the invention to the mash befitting it. The present invention allows the operator to enjoy himself in manipulating and observing its moving parts, while at the same time making the desired statement to and/or entertaining observers or others around him. Those observers will probably wish to obtain and operate the invention for themselves and to observe its moving parts more closely.

Another object of the present invention is to provide a noisemaker for augmenting or enhancing the effects of its use as discussed in the previous paragraph, or for use simply for its sound effects, for example at a New Year's Eve party, political convention, or the like. The sound effects of the present invention result from and accompany the interaction of its parts as they undergo their unique rotary and translational movements.

Another object of the present invention is to provide a means for simply and effectively displaying or demonstrating those unique rotary and translation-1 movements.

SUMMARY OF THE INVENTION

According to the present invention, a container is provided with a closure member including a grinder base. The grinder base includes a pair of guide channels therein which are substantially perpendicular to one another and which intersect at the center of the base. A pair of shuttle members or shoes are slidingly disposed in the guide channels, one shoe being disposed in each channel, and are adapted for back-and-forth or reciprocating translational movement in the. channels. The shoes and guide channels are provided with cross-sections which permit such reciprocating translational movement of the shoes in the guide channels, but which prevent removal of the shoes from the channels in a direction transverse or normal to the direction of translation. A handle or crank i]pivotally attached to each of the shoes, and when the crank i rotated around the base, the shoes slide back and forth in their respective guide channels. The shoes are attached to the crank at the proper locations, and sized, to prevent the shoes from colliding or interfering with each other as they travel.

The bottoms of the channels are provided with serrations which are engaged by ribs on the bottoms of the shoes as the shoes traverse the channels. The ribs project downwardly from the ends of longitudinally axially extending leaves on the shoe bottoms.

BRIEF DESCRIPTION OF THE DRAWINGS

For a more detailed description of the preferred embodiment of the invention, reference will now be made to the accompanying drawings, wherein.

Figure 3:
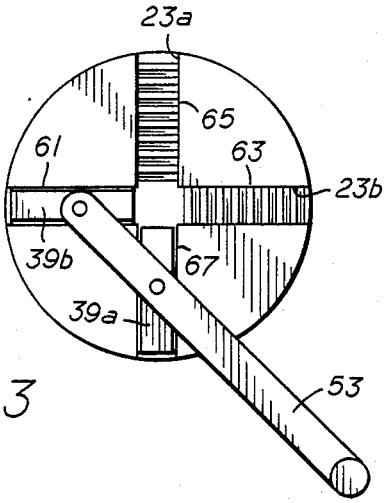
FIG. 3 is a top plan schematic view of the novelty grinder of FIG. 1 showing the shoes in a first position designated west/south for convenience.
Figure 6:
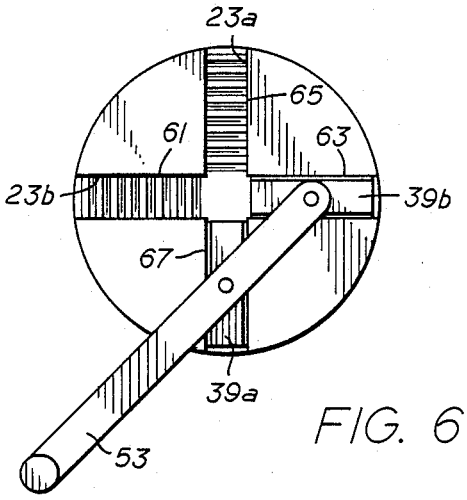
FIG. 6 is a top plan schematic view similar to FIGS. 3, 4, and 5 showing the crank rotated about 90° in a counter-clockwise direction from FIG. 5, with the shoes in an east/south position.

Rotation of the crank about 90° in a counter-clockwise direction from the position shown in FIG. 6 results in the parts reassuming the position shown in FIG. 3.

DESCRIPTION OF THE PREFERRED EMBODIMENT

Figure 1:
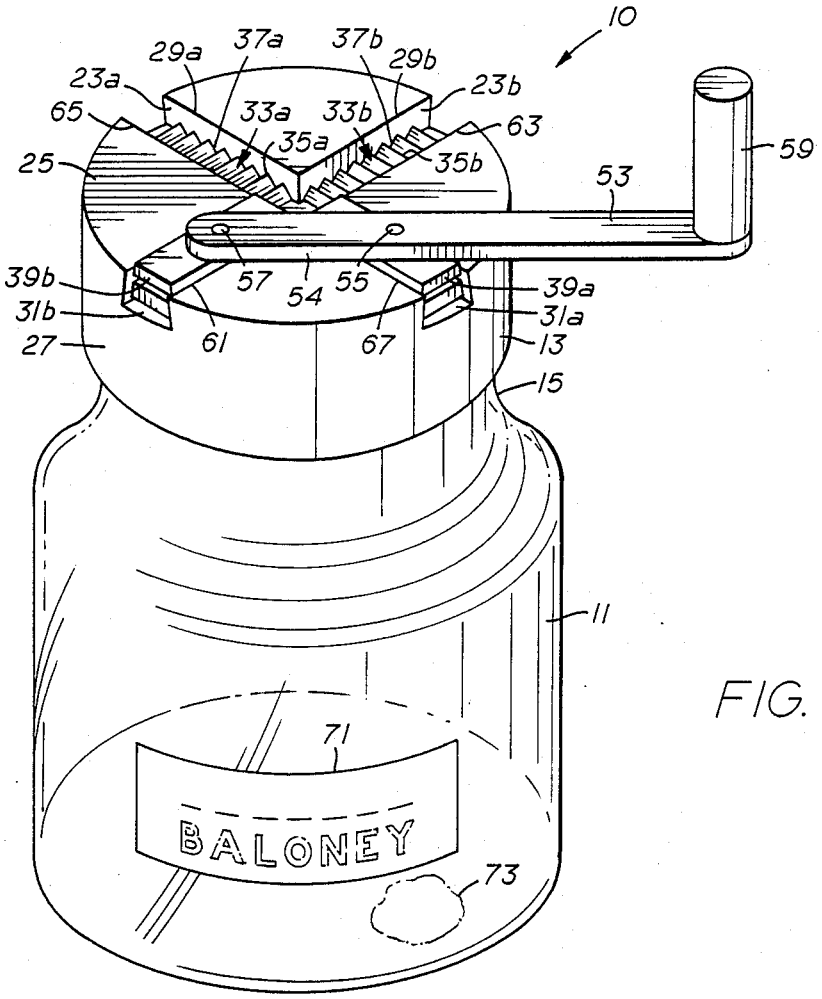
FIG. 1 is a top and side isometric view of the novelty grinder of the invention.
Figure 2:
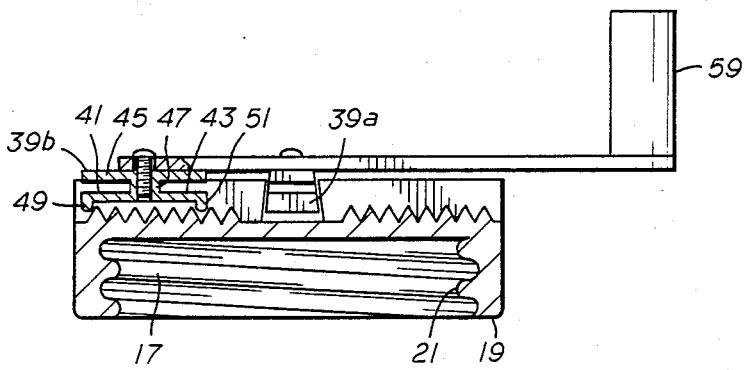
FIG. 2 is a view, partly in vertical cross-section and partly in elevation, of the novelty grinder of FIG. 1 with the container removed for clarity.

Referring initially to FIGS. 1 and 2, the novelty grinder of the present invention is shown generally at 10. Grinder 10 includes a container 11 having an open upper end (not shown) closed by a grinder base 13 mounted on the container. Container 11 may be a jar, bottle, box, or the like, of any convenient or desired and suitable shape, such as, for example, circular cylindrical, square, or rectangular. Container 11 may be provided with an upstanding neck portion 15 of reduced inner and outer diameter to facilitate attachment of grinder base 13 thereto.

Container 11 may be made of glass, plastic, wood, metal, ceramic or any other suitable material having sufficient strength and rigidity to support the grinder base when it is operated as described briefly above and more fully below. If a material such as clear or transparent glass or plastic is used for container 11, the interior of the container and its contents will be visible from the outside when the grinder is fully assembled as shown in FIG. 1. This will enhance the gag or amusing effect of the present invention when used as a display item, for example on a desk or bookshelf, but an added element of surprise may be realized if the container is made of substantially opaque material. In the latter event, the contents of the container are revealed only when the grinder base is removed, so that the operator may set the proper stage and give the gag more of a build-up before he or she delivers the punch line. He or she can symbolically grind up the offending subject matter and then surprise the amused onlooker with the "results" of the operation, i.e., the contents of the container. It should be understood that the precise material to be used for making container 11, whether it is to be translucent, transparent, or opaque, and what shape it is to be, are largely matters of design choice. The amusement value of the invention will not be substantially adversely affected no matter which material, shape, etc. is selected.

Grinder base 13 is secured to the open upper end (not shown) of container 11. Base 13 may be circular cylindrical in configuration, square, rectangular, or any other desired and suitable shape. If a circular cylindrical jar-type container 11 is used, then it is preferred that base 13 also be circular cylindrical in shape. In a preferred embodiment of the present invention, base 13 is a substantially solid, circular cylindrical member having an axially extending, circular blind bore 17 extending from its lower end 19. A screw thread 21 extends around the inner periphery of bore 17 for threaded engagement with a correlatively shaped screw thread around the outer periphery of neck 15 of container 11. Thus, grinder base 13 may be securely mounted by threaded engagement onto the container 11. Alternative means of attachment of base 13 onto container 11 may also be used, as long as a secure mounting is effected. For example, the exterior periphery of neck 15 may be provided with an annular projecting rib, and the inner periphery of bore 17 may be provided with an annular groove for receiving the rib, so that base 13 may be snapped or press fit onto the neck 15 of container 11. Although a releasable attachment is preferred, other alternative means of attachment include, for example, cementing, if the releasability feature is deemed less important.

Grinder base 13 includes a pair of guide channels or troughs 23*a*, 23*b* in its top or upper surface 25. Guide channels 23*a*, 23*b* are substantially perpendicular to one another and intersect substantially at the center of upper surface 25. Guide channels 23*a*, 23*b* extend diametrically across upper surface 25 and through the cylindrical outer side wall 27 of base 13. Channels 23*a*, 23*b* have a substantially uniform depth throughout their lengths, such depth being sufficient to retain the shuttle members or shoes (described more fully below) therewithin. The bottoms of channels 23*a*, 23*b* are substantially parallel to substantially planar upper surface 25. Guide channels 23*a*, 23*b* preferably have a dovetailed transverse cross-section, i.e., the width of each channel at its top 29*a*, 29*b*, respectively, is less than that at its bottom 31*a*, 31*b*, respectively. Guide channels 23*a*, 23*b* have serrated trough bottoms 33*a*, 33*b*, respectively, which include a plurality of transversely extending raised portions or ridges 35*a*, 35*b*, respectively. Ridges 35*a*, 35*b* are of substantially uniform height and have correlative valleys 37*a*, 37*b* therebetween.

Grinder base 13 may be made of any of the same materials of which container 11 is made. It is preferred, however, that base 13 be made of metal, such as brass, tin, steel, or aluminum, or a tough, strong, sturdy plastic. If a metal is used for base 13, the serrated trough bottoms 33*a*, 33*b* may be integrally formed in the channels 23*a*, 23*b* as part of a one-piece base unit. If a plastic material is used for the body of base 13, it is preferred that the trough bottoms 33*a*, 33*b* be made of metal, since metal serrated trough bottoms will better be able to withstand the wear and tear of repeated use of the device. Such metal serrated trough bottoms can be made as separate channel bottom inserts and attached to the bottoms of the guide channels by metal grommets, rivets, screws, or equivalent means, or by cementing, for example. If a sturdy and tough enough plastic is used, however, the base 13 can be made entirely in one piece of such plastic, including the serrated trough bottoms, without the necessity of mounting a separate metal serrated trough insert in the guide channels.

Figure 7:
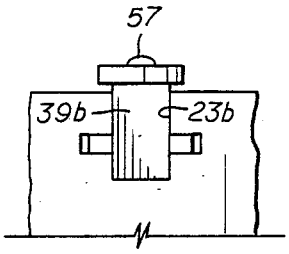
FIG. 7 is a fragmentary view, partly in vertical crossection and partly in elevation, showing an alternative means of retaining the shoes in the guide channels.
Figure 8:
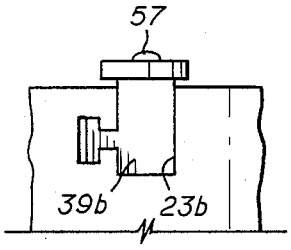
FIG. 8 is a view similar to FIG. 7, showing another alternative means of retaining the shoes in the guide channels.

Shuttle members or shoes 39*a*, 39*b* are slidably disposed in guide channels 23*a*, 23*b*, respectively. The shoes are adapted for back-and-forth translational movement in the channels, with neither shoe crossing into the adjacent channel. That is, shoe 39*a* reciprocates only in channel 23*a*, and shoe 39*b* reciprocates only in channel 23*b*. Each shoe is generally of an elongate trapezoidal configuration, and is slightly shorter than the quadrant legs of channels 23*a*, 23*b*, that is, those portions of the channels that extend from their intersecting radially inner side edges to their radially outer ends. In other words, each shoe can fit within the radially outermost portions of the channel in which it is disposed on each side of center without extending into the central area of intersection of the channels or protruding beyond the outer ends of the channels past side wall 27. Shoes 39*a*, 39*b* are wider at their bottoms than at their tops, with their trapezoidal cross-sections being shaped correlatively to the dovetailed cross-sections of the channels. The bottoms of shoes 39*a*, 39*b* are wider than the tops of the channels, so that the shoes cannot be removed from the channels in a direction normal or transverse to the bottoms of the channels, i.e., normal or transverse to surface 25. Shoes 39*a*, 39*b* are inserted into, and may be removed from, channels 23*a*, 23*b* at their radially outermost ends by sliding them longitudinally axially of the channels with the wide portion of the shoes corresponding to the wide portion of the channels. It should be understood that dovetailing of the channels and forming the shoes in trapezoidal configuration are not necessary, so long as some means is provided for allowing the shoes to reciprocate in the channels but preventing their removal in a direction normal to the surface 25. For example, a straight-sided channel could be used, with an axially extending groove in each of the two side walls for receiving a pin protruding transversely from each side of the shoes (FIG. 7). Alternatively, an axially extending T-slot may be provided in one of the channel walls, again assuming a straight-sided channel is used, for receiving a T-pin protruding transversely from one side of the shoes (FIG. 8). Other suitable alternatives will be apparent to those skilled in the art.

Shoes 39*a*, 39*b* each have a pair of longitudinally axially extending leaves 41, 43 (FIG. 2) on their bottoms. Since shoes 39*a*, 39*b* are substantially identical, except for the location of their attachment to the crank as described further below, only one will be described in greater detail, with the understanding that the description of one shoe will apply to the other, as well. Shoe 39*b* has an upper body portion 45, and a central body portion 47 extending downwardly therefrom. Leaves 41, 43 extend radially outwardly and inwardly, respectively, from central body portion 47 and are integrally attached thereto. As used in the preceding sentence and elsewhere herein, the terms "radially outward" and "radially inward" or the like refer to radial directions in respect of circular grinder base 13 shown, e.g., in FIG. 1. At the radially outermost or free end of leaf 41 there is a downwardly projecting rib 49, and there is a similar downwardly projecting rib 51 on the radially innermost or free end of leaf 43. Ribs 49, 51 are high enough to extend into the valleys 37*a*, 37*b* between serrations or ribs 35*a*, 35*b* when shoes 39*a*, 39*b* are at their upward travel limit with respect to channels 23*a*, 23*b*. When shoes 39*a*, 39*b* are caused to translate within guide channels 23*a*, 23*b*, there is sufficient spring in leaves 41, 43 to enable the ribs 49, 51 to ride up and over the serrations and to permit the leaves to spring back with the ribs extending again into the adjacent valleys, making a clicking or clattering noise as they go. With both ribs of each shoe exhibiting the foregoing "washboard" sound effect during operation, the clicking noises resulting from use of the invention will be quite loud, "rapid-fire" in frequency, and distinct.

Materials suitable for shoes 39*a*, 39*b* include wood, plastics, or metals. A metal, such as steel, is generally preferred for its wear-resistant qualities, and the increased loudness and better quality of "washboard" sound effects generated.

A crank or handle 53 of wood, plastic, or metal is pivotally attached to each of shoes 39*a*, 39*b*, such as by screws 55, 57, respectively, extending into the upper centers of the shoes. Other suitable fasteners such as rivets or nails could be used, so long as the crank is allowed to pivot a full 360° about the longitudinal axis of the fastening means. In the embodiment shown in the drawings, screws 55, 57 are screwed into and secured in the central body portions of the shoes, but are loosely and rotatably disposed in transverse bores through crank 53. The bores in the crank which receive screws 55, 57 are smaller in diameter than the outer diameter of the heads of screws 55, 57, but larger in diameter than the screw shanks, thereby serving to retain crank 53 on shoes 39*a*, 39*b* while allowing rotation of the crank around the shoes. A gripping lug 59 extends upwardly from the free end of crank 53 and is rotatably mounted on the crank, for example by a stud slidably disposed in a transverse bore through the crank and threadedly secured into the lug from its underside, so that the crank may be rotated a complete revolution while the operator holds onto the lug.

Crank 53 is attached to the shoes so that when shoe 39*b* is in the "west" leg of channel 23*b* and shoe 39*a* is in the "south" leg of channel 23*a*, the shaft 54 of crank 53 forms substantially a 45° angle with channel 39*b*. This is the position illustrated in FIG. 1. In FIG. 1, the "west" leg of channel 23*b* is indicated at 61, and the "east" leg of channel 23*b* at 63; the "north" leg of channel 23*a* is indicated at 65, and the "south" leg of channel 23*a* at 67.

Figure 4:
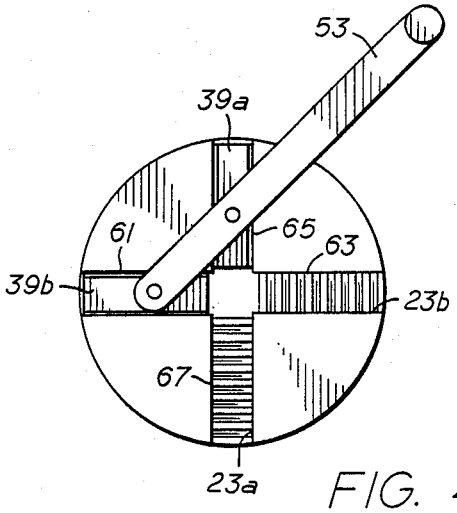
FIG. 4 is a top plan schematic view of the novelty grinder of FIG. 1 showing the crank rotated about 90° in a counter-clockwise direction from FIG. 3, with the shoes in a west/north position.
Figure 5:
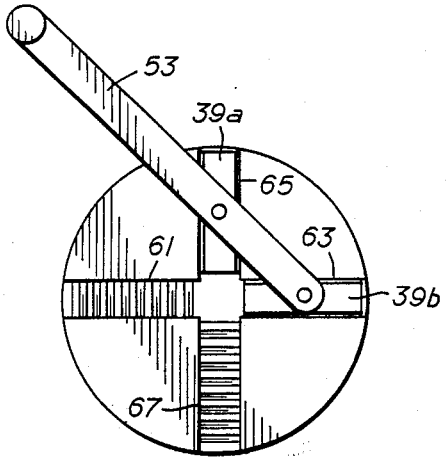
FIG. 5 is a top plan schematic view similar to FIGS. 3 and 4 showing the crank rotated about 90° in a counter-clockwise direction from FIG. 4, with the shoes in an east/north position.

Referring now to FIGS. 3–6, the position illustrated in FIG. 1 is also that illustrated in FIG. 3. When crank 53 is rotated about 90° in a counter-clockwise direction from the position of FIG. 3, shoe 39*a* moves from the south leg to the north leg of channel 23*a*, resulting in the position illustrated in FIG. 4. When crank 53 is rotated about 90° in a counterclockwise direction from the position of FIG. 4, shoe 39*b* moves from the west leg to the east leg of channel 23*b*, resulting in the position illustrated in FIG. 5. When crank 53 is rotated about 90° in a counter-clockwise direction from the position of FIG. 5, shoe 39*a* moves from the north leg to the south leg of channel 23*a*, resulting in the position illustrated in FIG. 6. Rotation of crank 53 about 90° in a counter-clockwise direction from the position illustrated in FIG. 6 results in a return to the position illustrated in FIGS. 1 and 3. Thus, it can be seen that rotation of crank 53 about the circumference of grinder base 13 causes shoes 39*a*, 39*b* to shuttle back and forth or reciprocate in channels 23*a*, 23*b*. The grinder base, channels, and shoes are sized such that the shoes do not collide or otherwise interfere with one another as they move back and forth across the surface of the grinder base in their respective channels from one side to the diametrically opposed side of the base. It should be understood that crank 53 may be rotated about grinder base 13 in a clockwise as well as a counter-clockwise, direction. In that event, the sequence of movements of the shoes - can be represented by ordering FIGS. 3–6 as follows: FIG. 3, FIG. 6, FIG. 5, and FIG. 4, followed by a return to FIG. 3.

Referring again to FIG. 1, a label 71 is placed on container 11 so that the contents 73 of the container may be suitably identified. Material 73 may be, for example, dirt, mud, sand, modeling clay, or other inorganic material, or any organic substance as desired, such as sawdust, pencil shavings, or a natural fertilizer, or any plastic or other simulation of any of the foregoing. The possibilities for material 73 are limited only by the imagination and fortitude of the operator. It should be understood that any of a variety of labels 71 may be placed on container 11, again limited holly by the imagination of the operator. Of course, blank labels could be provided, so that the operator may have complete freedom to identify the contents as he or she wishes.

It should be understood that the present invention is not designed or intended to actually grind up anything; the grinding is purely symbolic. With the noise from the shoes rattling across the serrated troughs, however, and with suitably selected contents 73, suitably labeled, the illusion of actual grinding will be enhanced.

Figure 9:
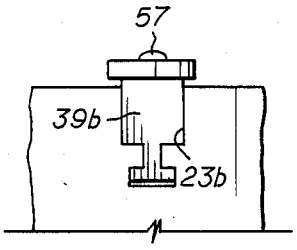
FIG. 9 is a view similar to FIG. 7, showing still another alternative means of retaining the shoes in the guide channels.

Those skilled in the art will appreciate that modifications to the above-described preferred embodiments of the invention can be made without departing from the substance and spirit of the invention. For example, the serrated surface in the guide channels need not be on the bottom, but instead may be on one or both of the side walls, and the rib or ribs for engaging the serrated surfaces will then be disposed on the corresponding facing sides of the shoes or shuttle members. If only one serrated surface is used on a side wall of a guide channel, then either the other side wall or the bottom of the channel may be provided with an axially extending T-slot, and the corresponding adjacent face of the shuttle member or shoe may be provided with a T-pin for riding in the T-slot for retaining the shuttle member in the guide channel. See, for example, FIG. 9, showing a T-slot in the guide channel bottom and a T-pin on the bottom of shuttle member 39*b*.

We claim:

1. A novelty grinder comprising:

a grinder base having an upper surface;

a container having an open upper end, said grinder base being mounted on and closing said open upper end of said container;

a pair of guide channels formed in the upper surface of said grinder base, said guide channels being substantially perpendicular to one another and intersecting substantially at the center of said upper surface of said grinder base;

a pair of shuttle members slidably disposed in said guide channels, each shuttle member being disposed in a separate one of said guide channels and being adapted for reciprocating translational movement in its respective guide channel;

retaining means disposed on said shuttle members and said guide channels for preventing the removal of said shuttle members from said guide channels in a direction transverse to the direction of their reciprocating translational movements;

crank means pivotally connected to each of said shuttle members for causing said reciprocating translational movement of said shuttle members in said guide channels when said crank means is rotated about said grinder base;

said guide channels having a dovetailed configuration in cross-section and said shuttle members having a cross-section that is wider at its widest point than the opening of said dovetailed guide channels, and further including a serrated surface in the bottom of each of said guide channels and a rib projecting from the bottom of each of said shuttle members, said ribs engaging each of the serrations of said serrated surfaces in succession when said shuttle members reciprocate in said guide channels.

2. A novelty grinder according to claim 1, wherein said ribs extend downwardly from the free ends of axially extending leaves disposed on the bottoms of said shuttle members.

3. A novelty grinder according to claim 2, including a second downwardly extending rib disposed on a second axially extending leaf on each of said shuttle members, said leaves being attached to said shuttle members at their center portions and extending to their free ends near the ends of said shuttle members.

4. A novelty grinder, comprising:

a container;

a grinder base mounted on said container;

first and second guide channels formed in the upper surface of said grinder base, said guide channels being substantially perpendicular to one another and having a dovetailed transverse cross-section and intersecting substantially at the center of such upper surface;

first and second shoes slidably disposed in said first and second guide channels, respectively, said shoes being adapted for reciprocating translational movement in said guide channels and having a greatest width larger than the narrowest width of said guide channels;

a crank pivotally connected to each of said first and second shoes such that when said shoes are disposed in adjacent quadrant legs of said channels, said crank is disposed at about a 45-degree angle to one of said guide channels, whereby when the crank is rotated about the grinder base the shoes are caused to move back and forth, in turn, in said guide channels;

said guide channels and said shoes being sized in order to avoid a collision of said shoes in the center of said grinder base as the shoes reciprocate in their respective guide channels; and serrated means disposed in said guide channels for engagement with projecting means disposed on said shoes as the shoes reciprocate, for creating a washboard-like sound effect.

* * * * *